US006405945B1

(12) United States Patent
Dobrin

(10) Patent No.: US 6,405,945 B1
(45) Date of Patent: Jun. 18, 2002

(54) NOZZLE FOR A FUEL INJECTOR

(75) Inventor: Victor Dobrin, Ypsilanti, MI (US)

(73) Assignee: Visteon Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/656,389

(22) Filed: Sep. 6, 2000

(51) Int. Cl.[7] ..... B05B 1/34; F02M 61/00

(52) U.S. Cl. ..... 239/463; 239/466; 239/533.12; 239/494

(58) Field of Search ..... 239/463, 466, 239/468, 472, 494, 490, 533.2, 533.3, 540, 585.1, 585.2, 585.3, 585.4, 585.5, 596, 5

(56) References Cited

U.S. PATENT DOCUMENTS 4,313,568 A * 2/1982 Shay ..... 239/494
4,793,913 A * 12/1988 Chessmore et al. ..... 208/113
5,435,884 A 7/1995 Simmons et al.
5,826,798 A * 10/1998 Schindler et al. ..... 239/403
6,016,969 A * 1/2000 Tilton et al. ..... 239/466
6,065,692 A * 5/2000 Brinn, Jr. ..... 239/585.4
6,142,390 A * 11/2000 Nordstrom et al. ..... 239/490

* cited by examiner

*Primary Examiner*—Lesley D. Morris
*Assistant Examiner*—Davis Hwu
(74) *Attorney, Agent, or Firm*—Visteon Global Tech., Inc.

(57) ABSTRACT

A nozzle 10 for a fuel injector assembly 12. Nozzle 10 includes several integrally formed ports 36 and chambers 38. Chambers 38 receive fuel from ports 36 and are effective to cause the received fuel to swirl and/or spiral through discharge holes 44, thereby causing the fuel to be finely and quickly atomized.

13 Claims, 3 Drawing Sheets

NOZZLE FOR A FUEL INJECTOR

FIELD OF THE INVENTION

This invention relates to a nozzle and more particularly, to a multi-hole nozzle for a fuel injector which provides an improved level of atomization relative to prior pressure-driven atomization mechanisms or nozzles.

BACKGROUND OF THE INVENTION

Nozzle assemblies are used in various devices such as automotive vehicles and are typically used to "atomize", vaporize or disperse pressurized liquid. For example and without limitation, one type of nozzle is typically and operatively disposed within a vehicle fuel injector and is used to atomize fuel before it is discharged into a combustion chamber of a vehicle engine. Particularly, the fuel injector nozzle is operatively and fixedly disposed within the fuel injector and is the last component or assembly that the fuel passes through before entering the combustion chamber.

The quality or level of atomization provided by the fuel injector nozzle directly and significantly effects the level of emissions and fuel economy of a vehicle. Particularly, a greater level or quality of atomization improves fuel economy and reduces emissions by promoting a more uniform and complete oxidation of hydrocarbons that are contained within the fuel. Furthermore, greater levels of fuel atomization provided by fuel injectors significantly reduce "cold-start" emissions and enable the usage of lower injection pressures for gasoline direct injection engines.

Various efforts have been made to increase the level of atomization provided by fuel injectors. For example and without limitation, nozzle assemblies with multiple holes have been used to increase the atomization of the fuel discharged from fuel injectors. However, these types of multi-hole nozzles do not always provide a significant improvement over single hole nozzles for practical hole sizes. Other efforts at increasing the level of fuel atomization provided by fuel injectors include providing an air delivery subsystem and increasing the pressure of the fuel by use of special pumps or additional components. These types of systems and methods, however, undesirably and significantly increase the cost of the fuel injection systems in which they are employed.

There is therefore a need for an improved fuel injector nozzle which overcomes some if not all of the drawbacks of prior fuel injector nozzles.

SUMMARY OF THE INVENTION

It is a first object of the invention to provide a nozzle which overcomes at least some of the previously delineated drawbacks of prior nozzles.

It is a second object of the invention to provide a nozzle which is adapted for use in combination with a vehicle fuel injector and which provides an improved level of atomization relative to prior fuel injector nozzles.

It is a third object of the invention to provide a nozzle for a fuel injector which provides an increased level of atomization of discharged fuel without substantially increasing the cost of the fuel injector.

According to a first aspect of the present invention, a nozzle is provided. The nozzle has a plurality of channels through which an amount of pressurized material selectively flows, and a plurality of chambers each of which is disposed at an end of a unique one of the plurality of channels and is effective to receive the pressurized material and to swirl the received pressurized material. Each of the plurality of chambers further includes an aperture which is effective to discharge the swirling pressurized material, thereby causing the discharged pressurized material to form a finely atomized spray.

According to a second aspect of the present invention, a method is provided for providing a nozzle for a fuel injector which discharges an amount of pressurized fuel. The method includes the steps of forming a plurality of channels within the nozzle, the plurality of channels being interconnected in a center portion of the nozzle and being effective to receive and channel the pressurized fuel; forming a plurality of chambers within the nozzle, each of the plurality of chambers being disposed at an end of a unique one of the plurality of channels which is remote from the center portion, the chambers being effective to receive the pressurized fuel and to cause the received pressurized fuel to spiral; and forming a hole within each of the plurality of chambers, the holes being effective to discharge the spiraling fuel as a finely atomized spray.

These and other features, aspects, and advantages of the invention will become apparent by reading the following specification and by reference to the following drawings.

DETAILED DESCRIPTION OF THE PREFERRED EMBODIMENT OF THE INVENTION

Figure 1:
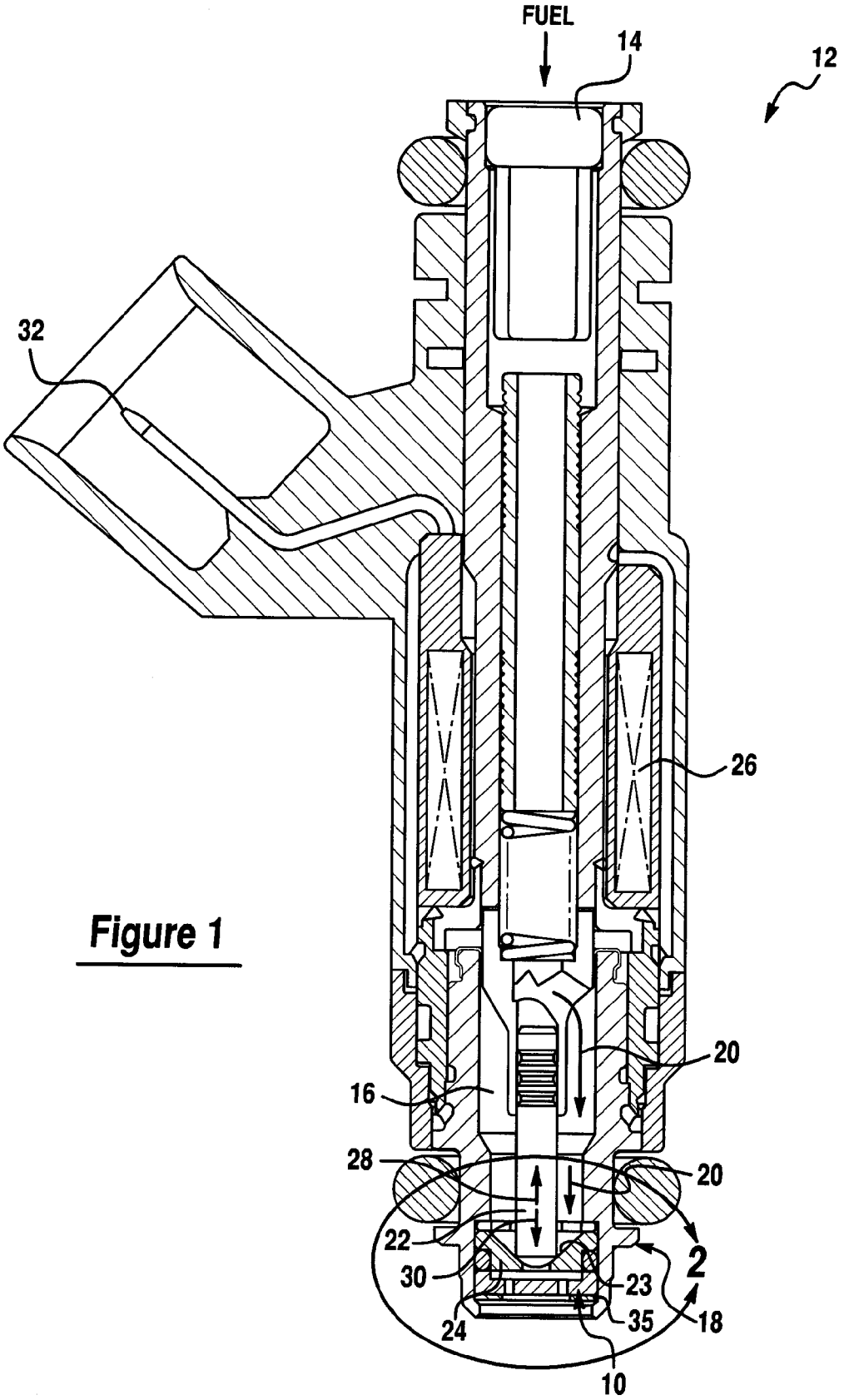
FIG. 1 is a sectional view of a nozzle which is made in accordance with the teachings of the preferred embodiment of the invention and which is operatively disposed within a vehicle fuel injector assembly.
Figure 2:
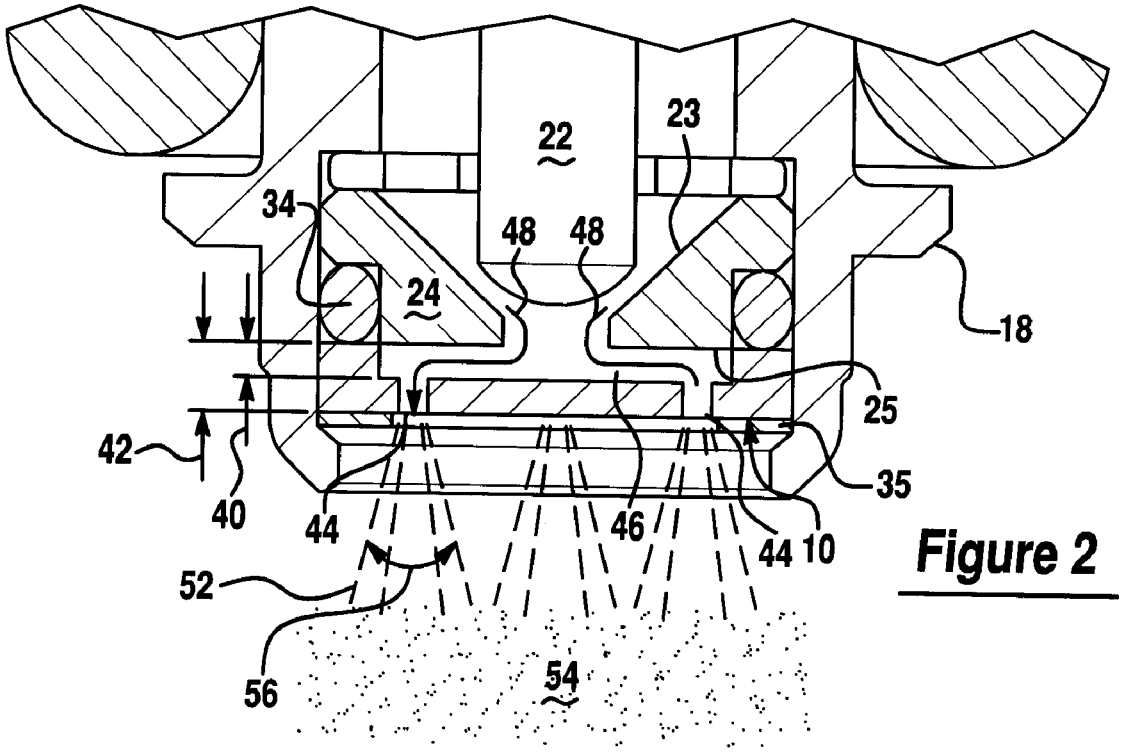
FIG. 2 is an enlarged sectional view of the region 2 which is illustrated in FIG. 1 and illustrates the fuel injector assembly in an actuated position.
Figure 3:
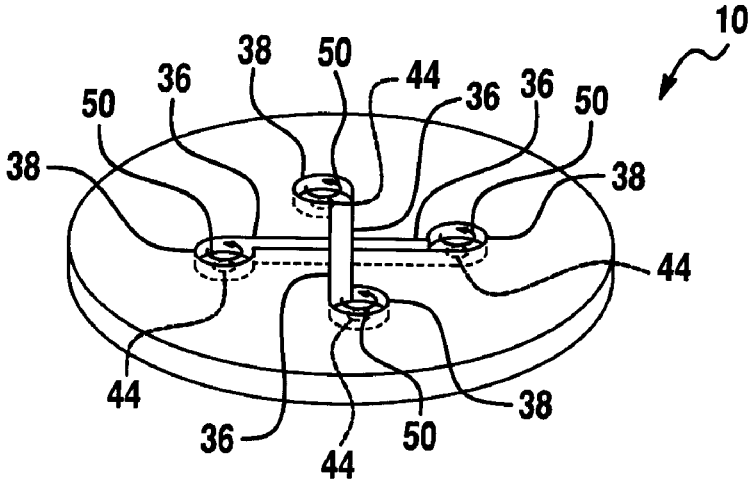
FIG. 3 is a perspective view of the nozzle shown in FIG. 1.

Referring now to FIGS. 1–3, there is shown a nozzle, member, or plate 10 which is made in accordance with the teachings of the preferred embodiment of the invention and which is adapted for use within a conventional vehicle fuel injector assembly 12. While the following discussion relates to the use of nozzle 10 in combination with a fuel injector assembly, it should be appreciated that in other alternate embodiments, nozzle 10 may be used with various other devices and assemblies in order to selectively discharge and finely atomize other types of pressurized fluid or material.

Fuel injector assembly 12 includes a fuel intake port or conduit 14 that selectively receives liquid and/or vaporized fuel. A generally cylindrical channel 16 is formed within the valve body assembly 18 of the fuel injector 12, and communicates with port 14 to receive and channel fuel to nozzle 10. Fuel injector 12 further includes a selectively actuatable valve, needle or member 22 which is movably disposed within the channel 18 and which selectively engages a valve seat 24. Member 22 is selectively movable from a first position in which member 22 engages the inner surface 23 of a valve seat or member 24, effective to prevent fuel from being discharged through nozzle 10, and a second position in which member 22 is removed from seat 24 (e.g., as shown in FIG. 2), effective to allow fuel to be discharged from nozzle 10. In the preferred embodiment of the invention, coil assembly 26 selectively actuates member 22 (e.g. causes member 22 to move in the directions of arrows 28, 30) in response to control signals received through terminal 32, which is communicatively coupled to an engine control module (not shown).

Figure 4:
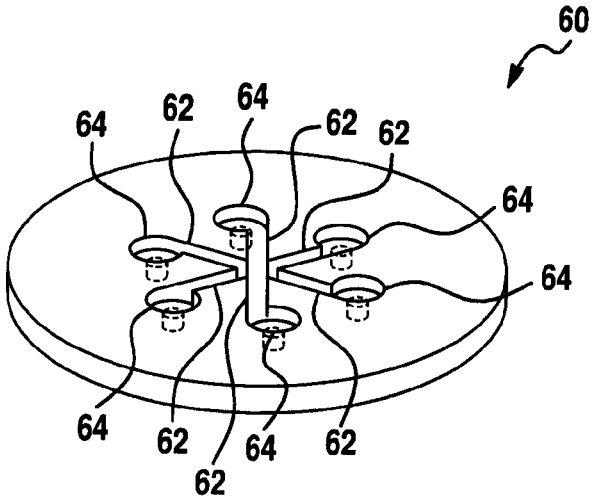
FIG. 4 is a perspective view a nozzle which is made in accordance with the teachings of a second embodiment of the present invention.

Nozzle 10 is fixedly disposed (e.g., laser welded) within body assembly 18 and partially abuts seat 24. Particularly, nozzle 10 is disposed immediately below seat 24, and cooperates with seat 24 to channel and discharge fuel from injector 12. A conventional annular seal or o-ring 34 is disposed between the outer portion or periphery of nozzle 10 and the outer portion or periphery of seat 24, and effective to prevent fuel from "leaking" from injector 12. A "back-up" washer 35 abuts nozzle 10 and holds nozzle 10 against seat 24. Nozzle 10 is preferably manufactured from a corrosive resistant material and includes several grooves, ports or channels 36 which are interconnected at the approximate center of nozzle 10. Nozzle 10 further comprises several "swirl" chambers 38, each of which is disposed at the end of (e.g., at the end of channel 36 remote from the center of nozzle 10) and communicates with a unique one of channels 36. In the preferred embodiment, four such channels 36 and chambers 38 are formed within nozzle 10, and cooperate with the bottom surface 25 of seat 24 to form passages or conduits 46 through which fuel selectively flows (e.g., in the directions of arrows 48) prior to being discharged from nozzle 10. In other alternate embodiments, different numbers of channels 36 and chambers 38 may be formed within nozzle 10. For example and without limitation, one non-limiting embodiment of a nozzle 60 is illustrated in FIG. 4 and includes six interconnected channels 62 and six chambers 64.

In the preferred embodiment of the invention, channels 36 and chambers 38 each have a depth 40 which is equal to approximately half of the thickness 42 of nozzle 10. Each chamber 38 includes an aperture or discharge hole 44 which allows fuel within the chamber 38 to be discharged from nozzle 10, as shown in FIG. 2. Each chamber 38 has a generally "helical" shape which, as described more fully and completely below, is effective to cause the fuel that is channeled into the chamber 38 to "swirl" and/or spiral prior to being discharged from aperture 44. In alternate embodiments, chambers 38 may have other shapes that are effective to cause fuel that is channeled into the chambers to "swirl" and/or spiral.

Figure 5:
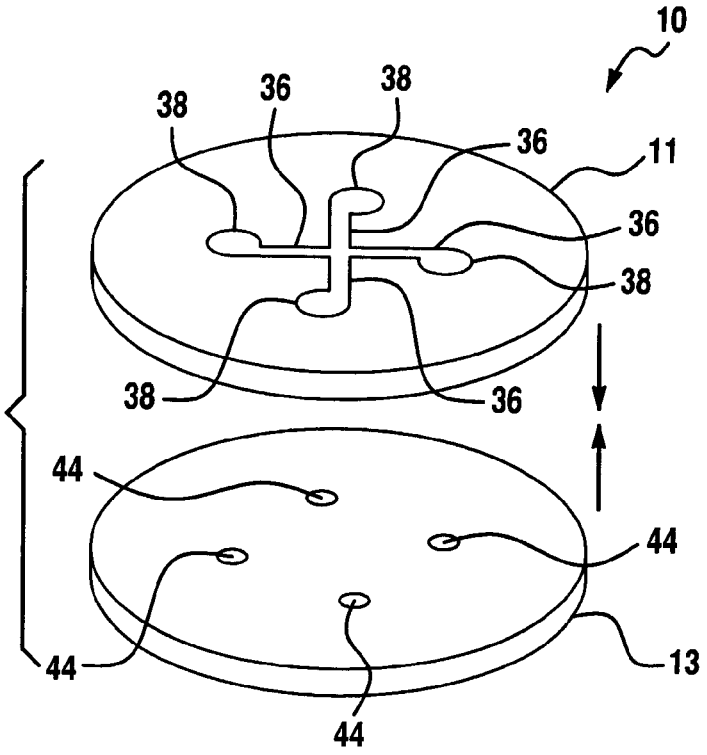
FIG. 5 is a perspective unassembled view of a nozzle which is formed in accordance with an alternate embodiment of the present invention.

In the preferred embodiment of the invention, ports 36, chambers 38 and holes 44 are formed within nozzle 10 by use of a conventional chemical etching, stamping or electroforming process. In one non-limiting embodiment illustrated in FIG. 5, nozzle 10 is formed from two generally circular plates or members 11 and 13. As shown in FIG. 5, plate 11 includes or contains channels 36 and swirl chambers 38 which are integrally formed within plate 11, and plate 13 includes or contains discharge holes 44 which are integrally formed in plate 13. In this alternate embodiment, nozzle 10 is assembled by aligning chambers 38 with holes 44 and joining plates 11 and 13 in a conventional manner, such as by use of a conventional adhesive or a conventional bonding process.

In operation, when valve 22 is actuated or moved in the direction of arrow 28, pressurized fuel and/or vapor is channeled or directed away from the center of nozzle 10 through ports 36 in the direction of arrows 48 and into swirl chambers 38. Each chamber 38 receives the pressurized fuel and/or vapor and acts as a "swirl" or vortex generator causing rotational or angular motion (e.g., motion in the directions of arrows 50) to be imparted upon the pressurized fuel. Particularly, the direction and pressure of the traveling fuel and the shape of chambers 38 causes the fuel to relatively rapidly swirl and/or spiral within the chambers 38. The rapidly swirling and/or spiraling fuel is then discharged through holes 44 as conical sheets 52 which combine and/or merge with each other and relatively quickly disintegrate into a finely atomized spray 54. In the preferred embodiment of the invention, discharge holes 44 are positioned and/or formed within chambers 38 so as to correspond and/or be aligned with the center or "eye" of the vortexes or spirals generated within the chambers. The swirling and/or spiraling motion generated within chambers 38 and the multiple intermixing conical sheets 52 cause the discharged fuel to have improved atomization qualities relative to prior nozzles. Particularly, the discharged fuel is "disintegrated" or atomized faster and has a higher level of atomization relative to prior nozzles. It should be appreciated that the dimensions of the ports or channels 36, swirl chambers 38 and discharge holes 44 may be designed and/or adjusted to achieve certain requirements or criteria regarding fuel flow rates, fuel droplet size distribution, and/or the angles 56 of conical sheets 52.

It is to be understood that the invention is not to be limited to the exact construction and/or method which has been illustrated and discussed above, but that various changes and/or modifications may be made without departing from the spirit and the scope of the invention.

What is claimed is:

1. A nozzle comprising a plurality of interconnected channels which reside within a single plate; and a plurality of chambers which reside within said single plate, each of said plurality of chambers being disposed at an end of a unique one of said interconnected channels, whereby pressurized material is received upon said plate and flows through said interconnected channels and is communicated to and received by said plurality of chambers which are effective to swirl said received pressurized fuel and to emit said pressurized fuel.

2. The nozzle of claim 1 wherein said pressurized material comprises fuel.

3. The nozzle of claim 1 wherein each of said plurality of chambers is generally helical in shape.

4. The nozzle of claim 1 wherein said nozzle assembly is adapted for use in combination with a conventional vehicle fuel injector.

5. The nozzle of claim 1 further comprising a first plate in which said plurality of channels and said plurality of chambers are integrally formed and a second plate which is fixedly coupled to said first plate and in which said plurality of apertures are integrally formed.

6. The nozzle of claim 5 wherein said plurality of channels and said plurality of chambers are integrally formed in said first plate by use of a stamping process.

7. The nozzle of claim 5 wherein said plurality of channels and said plurality of chambers are integrally formed in said first plate by use of a chemical etching process.

8. The nozzle of claim 5 wherein said plurality of channels and said plurality of chambers are formed by use of an electroforming process.

9. A method for providing a nozzle for a fuel injector which discharges an amount of pressurized fuel, said method comprising the steps of:

forming a plurality of channels within said nozzle, said plurality of channels being interconnected in a center portion of said nozzle and being effective to receive and channel said pressurized fuel;

forming a plurality of chambers within said nozzle, each of said plurality of chambers being disposed at an end of a unique one of said plurality of channels, said chambers being effective to receive said pressurized fuel and to cause said received pressurized fuel to spiral; and forming a hole within each of said plurality of chambers, said holes being effective to discharge said spiraling fuel as a finely atomized spray.

10. The method of claim 9 wherein said plurality of channels and said plurality of chambers are formed within a first portion of said nozzle by use of a chemical etching process.

11. The method of claim 9 wherein said plurality of channels and said plurality of chambers are formed within said nozzle by use of a stamping process.

12. The method of claim 9 wherein said plurality of chambers and said plurality of channels are formed within a first portion of said nozzle and said discharge holes are formed within a second portion of said nozzle, said method further comprising the steps of:

aligning said first portion with said second portion of said nozzle; and selectively attaching said first portion to said second portion.

13. The method of claim 12 wherein said first portion is selectively attached to said second portion by use of an adhesive material.

* * * * *